US007946460B2

(12) United States Patent
Yip

(10) Patent No.: US 7,946,460 B2
(45) Date of Patent: May 24, 2011

(54) INTERACTION TYPE OF BALANCED DEVICE

(76) Inventor: Kaiming Yip, Hong Kong (CN)

( * ) Notice: Subject to any disclaimer, the term of this patent is extended or adjusted under 35 U.S.C. 154(b) by 638 days.

(21) Appl. No.: 11/993,977

(22) PCT Filed: Jun. 23, 2006

(86) PCT No.: PCT/CN2006/001439

§ 371 (c)(1),
(2), (4) Date: Dec. 27, 2007

(87) PCT Pub. No.: WO2007/003104

PCT Pub. Date: Jan. 11, 2007

(65) Prior Publication Data

US 2008/0197163 A1 Aug. 21, 2008

(51) Int. Cl.
*A45F 3/04* (2006.01)

(52) U.S. Cl. ..... 224/631; 224/627

(58) Field of Classification Search ..... 224/576, 224/579, 627, 631, 632; *A45F 3/04, 3/06*
See application file for complete search history.

(56) References Cited

U.S. PATENT DOCUMENTS

| | | | | |
|---|---|---|---|---|
| 2,197,427 | A * | 4/1940 | Despain | 224/635 |
| 3,797,718 | A * | 3/1974 | Plant | 224/262 |
| 4,154,381 | A * | 5/1979 | Zufich | 224/262 |
| 4,189,076 | A * | 2/1980 | Zufich | 224/631 |
| 5,806,740 | A * | 9/1998 | Carlson | 224/628 |
| 6,070,776 | A * | 6/2000 | Furnary et al. | 224/627 |
| 7,152,771 | B2 | 12/2006 | Le Gal et al. | |
| 7,600,660 | B2 * | 10/2009 | Kasper et al. | 224/162 |
| 2008/0185411 | A1 * | 8/2008 | Rome et al. | 224/633 |

FOREIGN PATENT DOCUMENTS

| | | |
|---|---|---|
| CN | 2659216 | 12/2001 |
| JP | 2003259916 | 9/2003 |
| JP | 2004364486 | 12/2004 |
| WO | 2004/100706 | 11/2004 |

* cited by examiner

*Primary Examiner* — Justin M Larson
(74) *Attorney, Agent, or Firm* — Schmeiser, Olsen & Watts, LLP

(57) ABSTRACT

An interactive type of a balancing device comprises a backpack body, a balancing device, left and right shoulder straps whose top end and tail end can be connected with or detachably connected with the balancing device respectively. The balancing device is consisted of a lower assembly and an upper assembly connected with the backpack body and supported by the lower assembly. The left and right shoulder straps move along a rotating assembly of the upper assembly. The lower assembly connected with the backpack body is consisted of a baffle plate and a moveable device which is installed in a hollow part of an interlayer of the baffle plate. The upper assembly and lower assembly can be used at the same time or be used by itself.

8 Claims, 6 Drawing Sheets

INTERACTION TYPE OF BALANCED DEVICE

TECHNICAL FIELDS OF THE INVENTION

This invention involves one kind of day-to-day used backpack shelf, particularly involving the use of a backpack interactive balanced device.

PRIOR ART

The backpack is now commonly used to carry heavy objects, by two straps crossing the left and right shoulders, but when the shoulders are moving up-down, the straps will be pulled and the gravity center of the backpack will be changed at the same time, so that the two shoulders of the people will be unevenly loaded. On the other hand, when the user's shoulders move up-down, the weight of the backpack will concentrate relatively on the moving shoulder, that will make the user to be difficult to move and lose balance easily because of the gravity center shift. The long time weight pressure and load imbalance will affect muscle and damage waist, result in lumbar spine and spinal disease. There is another kind of movable device that can balance the gravity center of the backpack, which works through a sliding belt at the bottom of the backpack driven by a shoulder strap. The shortcomings are: the sliding belt can not move fluently, but tangles easily. And when the backpack is overloaded, the pressure would affect this kind of movable device's ability to move, thereby reduce it's beneficial effects of balancing the backpack gravity center.

PURPOSE OF THE INVENTION

In order to settle the said problems, the purpose of this invention is to provide an interactive type of a balancing device to fix the backpack gravity center. This invention is simple in structure, easy to use, even when the user is moving, the loads on both shoulders will also keep even, and thereby make the back muscles work under uniform stress, which will reduce the harm caused by the uneven stress on the muscles.

TECHNOLOGY OF THE INVENTION

The purpose of this invention is realized by the following methods: An interactive type of a balancing device comprising a backpack body, left and right shoulder straps, and a balancing device. a top end and a tail end of said left and right shoulder straps being connected with or detachably connected with the balancing device respectively, wherein said balancing device includes an upper assembly and a lower assembly;

The upper assembly is connected with the backpack body through a plate of plastic or metal, and supported by the lower assembly. The left and right shoulder straps move along a rotating assembly of the upper assembly.

The lower assembly is connected with the backpack body and consisted of a baffle plate and a movable device which is installed in a hollow part of an interlayer of the said baffle plate.

As above said movable device is installed in the hollow part of an interlayer of said baffle plate, including at least one rolling wheel and two fixed wheels set on both the left and right side, a sliding belt is driven by the left and right shoulder straps to move along the rolling wheel and the fixed wheels within a positioning component channels, and the rolling wheel is connected with the baffle plate by a spring.

As above said rotating assembly includes a positioning rotary wheel which is rotating around the axis, and a channel is set around the rotating wheel, thereby the left and right shoulder straps can move right or left side within the channel along the outer track of the wheel.

The rolling wheel in this invention could be one wheel or a group of wheels, the sliding belt is controlled by a keyswitch installed between the rolling wheels, so that the straps could be locked or moved.

The baffle plate in this invention includes a center main plate and left and right sliding plates. The baffle plate has a hollow double-layer sandwich structure, and the bottoms of the left and right sliding plate have positioning components channels which are connected to the outside respectively. The sliding belt move along the positioning components channels and extend from the channels to connected with the shoulder straps.

Due to the adoption of the above technical scheme, the upper assembly and the lower assembly can be fixed at the back of the backpack, and the lower assembly can be fixed or detachably installed at the bottom of the backpack or the inner or outer layer of the back of the backpack. When the shoulders of the user move around and up and down, the shoulder straps will drive the slipping belts slide left or right through the movable device within the lower assembly, at the same time the rotating assembly within the upper assembly will also make the shoulder straps move along the channel, so that the length of the left and right shoulder straps will be regulated immediately, thereby to adjust the backpack gravity center appropriately, and the weigh of the backpack will be always apportioned evenly between the two shoulders. Similarly, the rotating assembly of the upper assembly will also drive the shoulder straps to slip within the rotating assembly, achieving the purpose of interaction balance.

EMBODIMENTS

Figure 1:
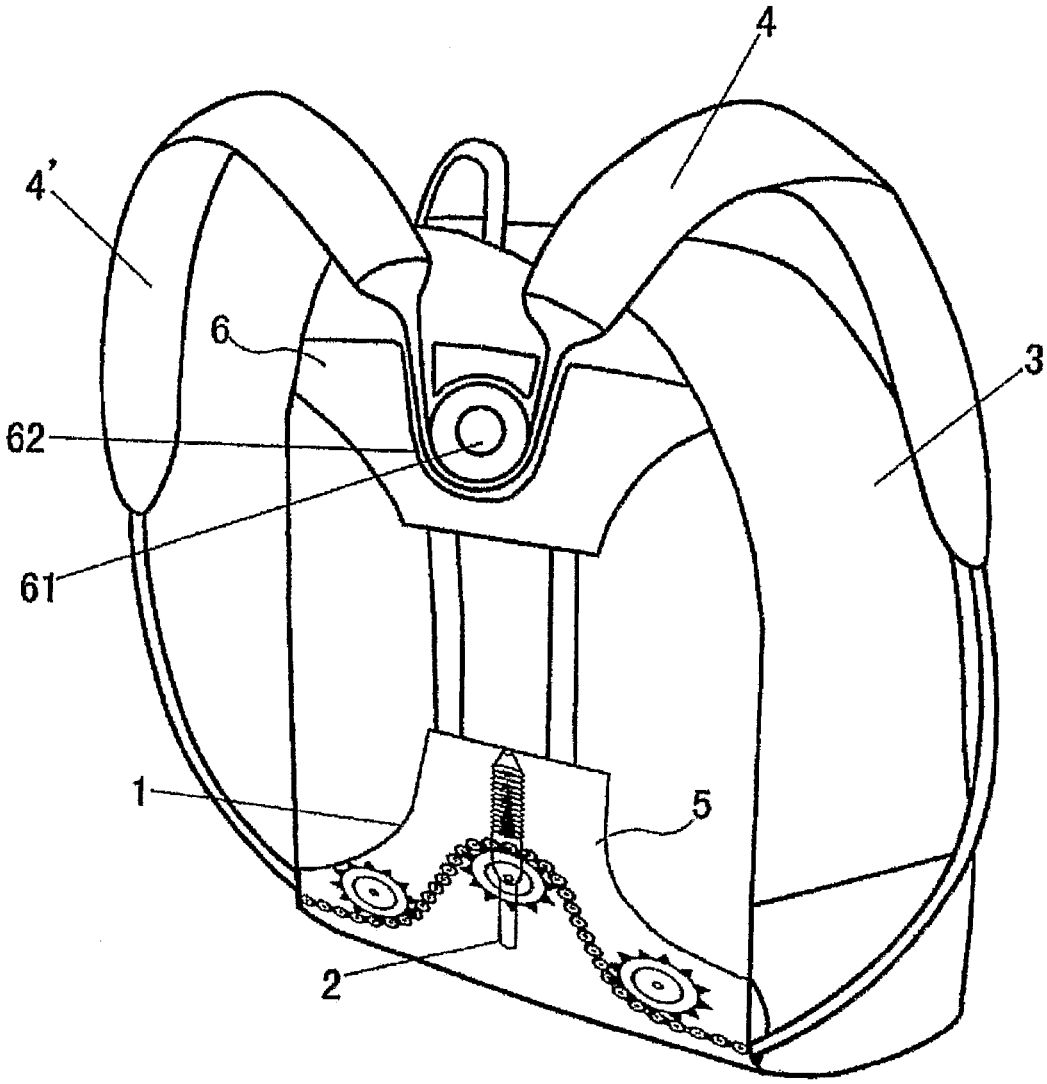
FIG. 1 is a perspective view of the back of the backpack, showing the structure of the present invention.

As shown in FIG. 1, the present invention includes a backpack body 3, a left shoulder strap 4 and a right shoulder strap 4', and a balancing device. Both the top end and tail end of the left shoulder strap 4 and right shoulder strap 4' are connected to or even movably connected to the balancing device respectively, the balancing device also includes an upper assembly 6 and a lower assembly 5;

the lower assembly 5, which is connected with the backpack body 3, is composed of a baffle plate 1 and a movable device 2 which is fixed within the hollow part of an interlayer of the baffle plate 1;

the upper assembly 6 is connected to the backpack body 3 through a plate, and is supported by the lower assembly 5. The left shoulder strap 4 and right shoulder strap 4' move along the rotating assembly 61 of the upper assembly 6.

The lower assembly 5 is fixed on the backpack body 3 through the baffle plate 1, the baffle plate 1 has a hollow sandwich structure, the movable device 2 is fixed within the interlayer, the movable device 2 is consisted of one center-located rolling wheel and two fixed wheels at both side respectively, and the slipping belt moves between the rolling wheel and the fixed wheels driven by the shoulder straps 4, 4'.

The upper assembly 6 is connected with the backpack body 3, the rotating assembly 61 is rotated by a turning wheel around an axis, between the felloe of the turning wheel and the plate there is a channel 62, thereby the shoulder straps can move left and right through the turning wheel, and it is interaction, so that the gravity center of the backpack will be maintained perpendicular to the ground.

Shoulder straps 4, 4' and the slipping belt of the lower assembly 5 or the upper assembly 6, may be fixed or detachably connected together.

Figure 2:
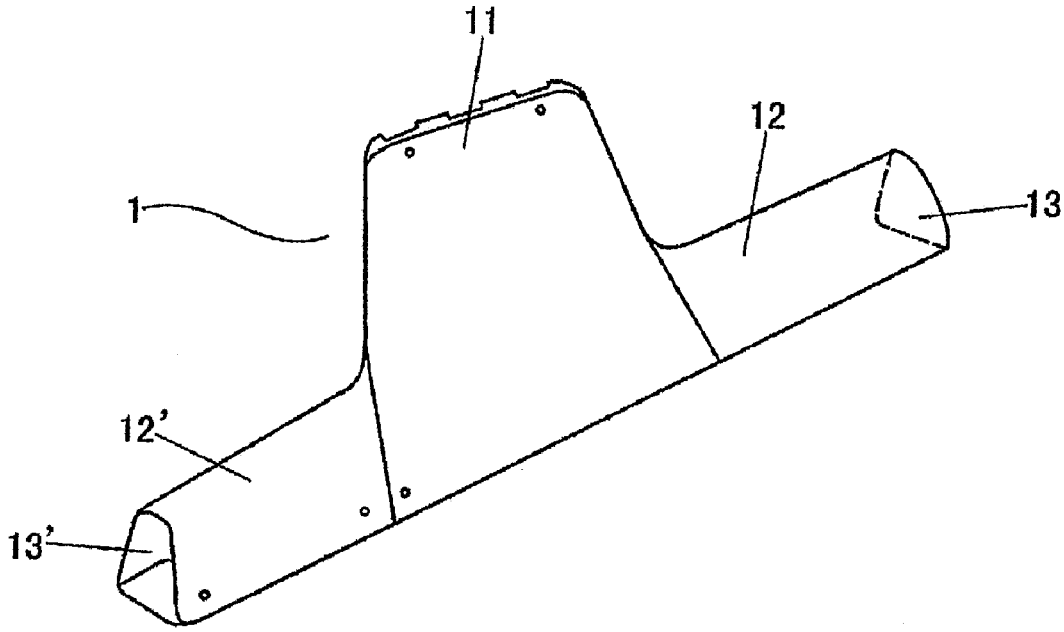
FIG. 2 is the front perspective view of the baffle plate of the lower assembly.
Figure 3:
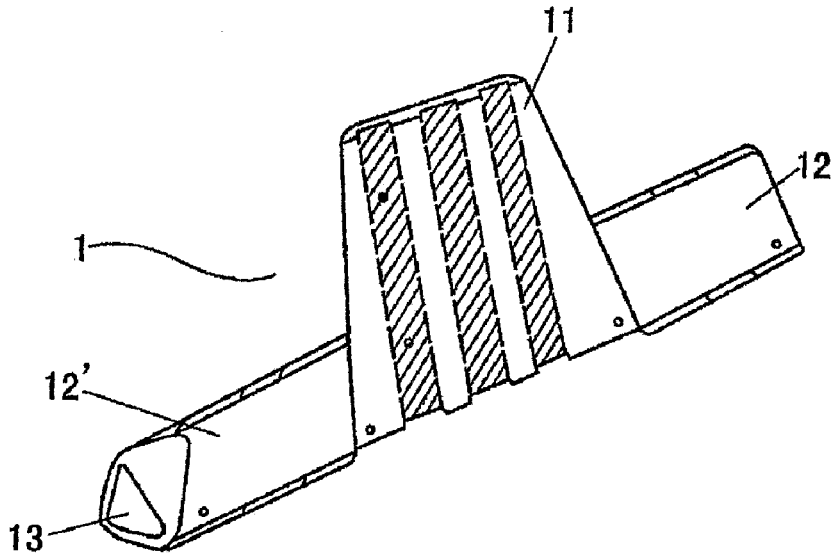
FIG. 3 is the back perspective view of the baffle plate of the lower assembly.
Figure 4:
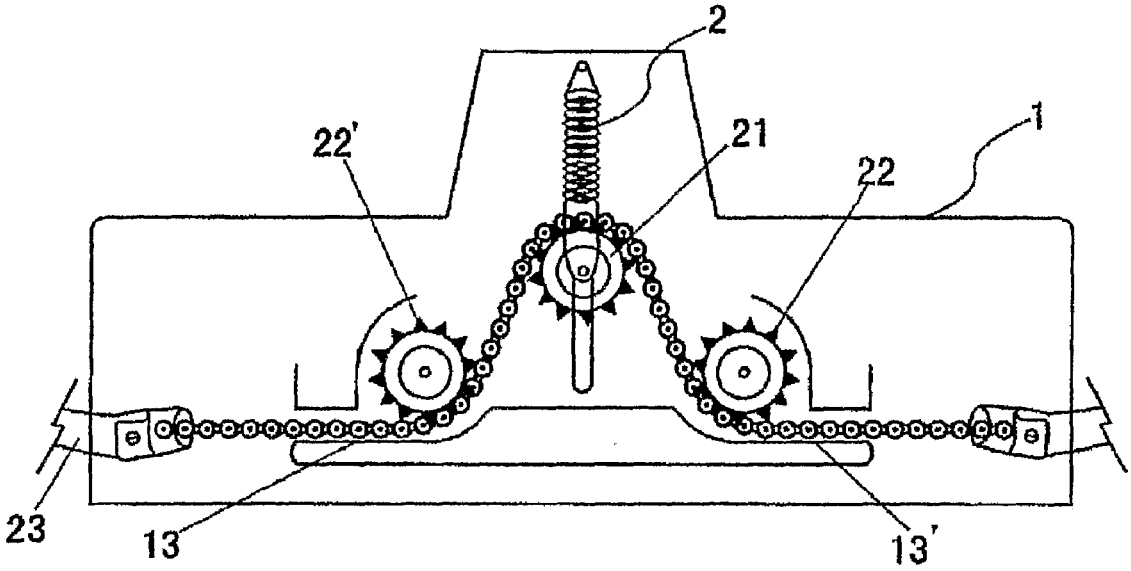
FIG. 4 is the front view of the movable device of the lower assembly in the first example.

As shown in FIG. 2, FIG. 3 and FIG. 4, the baffle plate 1 which is set on the lower assembly 5, has a hollow sandwich structure. The baffle plate is consisted of a main plate 11 and a left sliding plate 12 and a right sliding plate 12', and the left sliding plate 12 and right sliding plate 12' are connected to the relative sides of the main plate 11, as well as they can move along the main plate 11. At the same time, positioning channels 13, 13' are disposed at the bottoms of the left and right sliding plates 12, 12' to connect to outside, the sliding belt 23 extending outside from the movable device 2 can be connected or be detachably connected to the end of the left and right shoulder straps 4, 4'. A plurality of reinforcements 111 are set on the main plate 11 to enforce the support force of the main plate 11.

The movable device 2 includes a rolling wheel 21 and fixed wheels 22, 22' located at the left side and right side of the rolling wheel respectively. The rolling wheel 21 is fixed on the baffle plate 1 by a spring. The sliding belt 23 is a chain, which is extended from the positioning channels 13, 13' and connected to the end of the left and right shoulder straps 4, 4'. The sliding belt 23 can slide along the rolling wheel 21 and the fixed wheels 22, 22' by pulling the left and right shoulder straps, which can maintain the gravity center of the backpack to unchanged.

Figure 5:
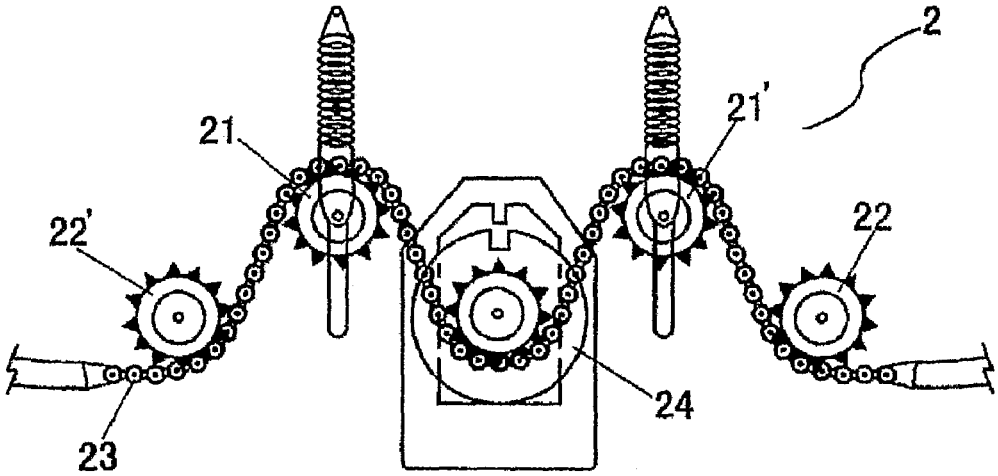
FIG. 5 is the front view of the movable device of the lower assembly in the second example.

FIG. 5 shows another embodiment of the movable device 2. The movable device 2 can also includes two rolling wheels 21,21'. A keyswitch 24 is located between the wheels 21 and 21', the movement of the sliding belt 23 can be controlled by controlling the key of the keyswitch. When the keyswitch 24 is in the open state, the sliding belt 23 can move left and right freely, and when the keyswitch 24 is in the close state, the sliding belt 23 will be locked, which stop the sliding of the shoulder straps 4, 4'. The other aspects of FIG. 5 are the same as FIG. 4.

Figure 6:
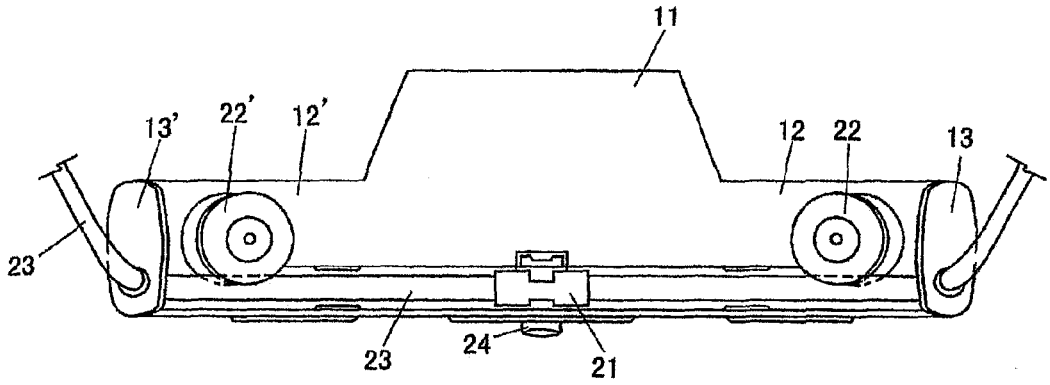
FIG. 6 is the front view of the movable device of the lower assembly in the third example.

As shown in FIG. 6, the sliding belt 23 can be leather belt, plastic belt, plastic pole or metal pole. The keyswitch 24 is installed in the rolling wheel 21. The sliding belt 23 is passed through the rolling wheel 21 and keyswitch 24, and the movement of the sliding belt 23 is controlled by the keyswitch 24, the other aspects of FIG. 6 are the same as FIG. 4.

Figure 7:
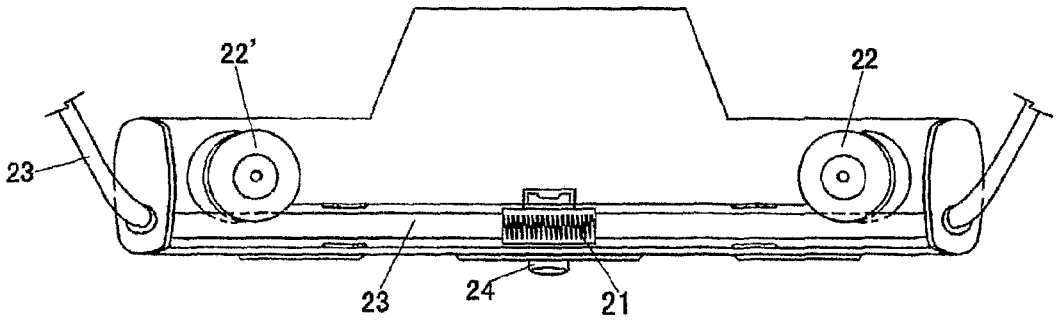
FIG. 7 is the front view of the movable device of the lower assembly in the forth example.

As shown in FIG. 7, the keyswitch 24 on the rolling wheel 21 is a spring.

Figure 8:
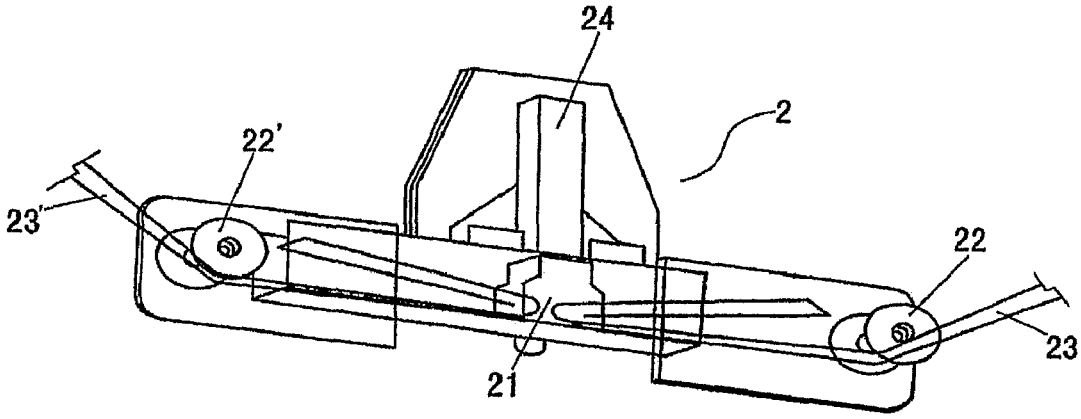
FIG. 8 is the front view of the movable device of the lower assembly in the fifth example.
Figure 9:
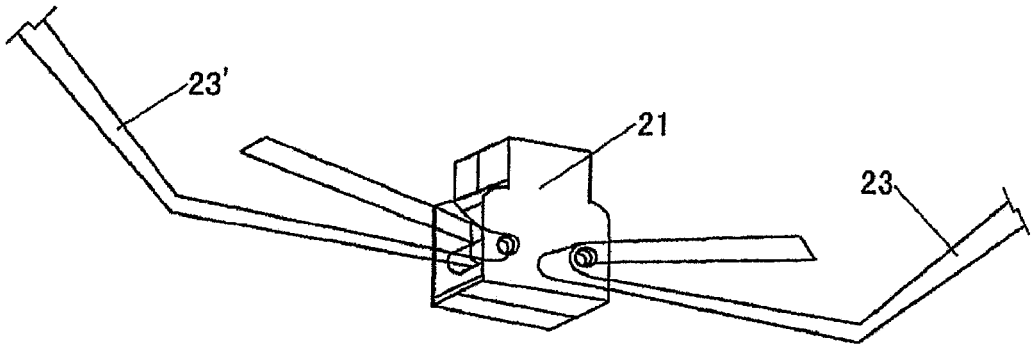
FIG. 9 is the part separated view of FIG. 8 (shoulder strap being locked)
Figure 10:
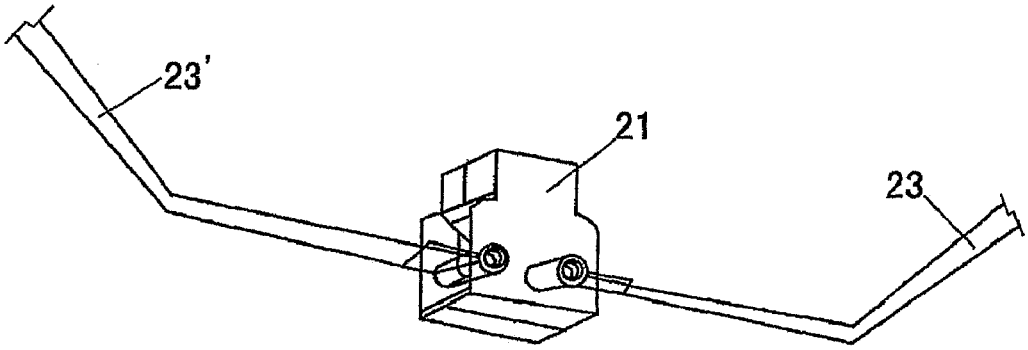
FIG. 10 is the part separated view of FIG. 8 (shoulder strap being stretched)

FIG. 8, FIG. 9, and FIG. 10 show another embodiment of the movable device of the lower assembly in the present invention. A keyswitch 24 is installed within the movable device 2. A fixed component 21 is fixed within the movable device 2, and is inserted by the keyswitch 24 to lock or open. A rotating axes is set on the fixed component 21, and the shoulder straps 23, 23' can move along the rotating axes through the fixed wheels 22, 22' at the left and right sides. The other aspects are the same as FIG. 6 and FIG. 7.

When using, the left shoulder strap 23 and right shoulder strap 23' can move along the fixed component 21. When it is need to fix the length of the strap, the keyswitch 24 can be locked manually, so that the shoulder straps 23, 23' can be locked in a fixed position, and the backpack can be balanced on the shoulders.

Figure 11:
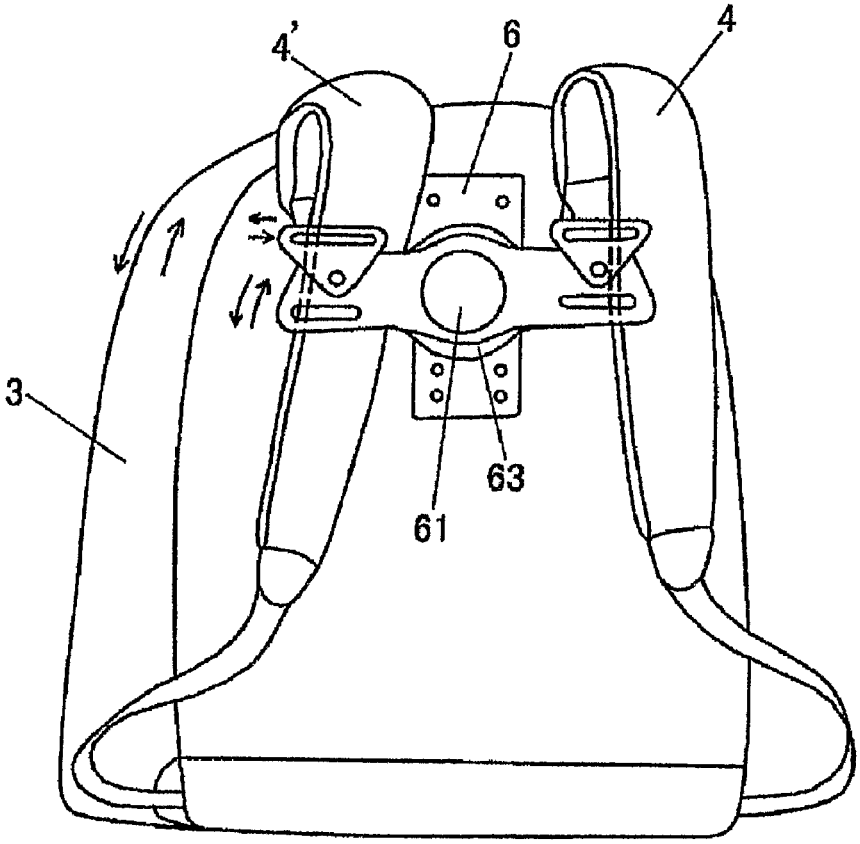
FIG. 11 is the back view of the backpack, showing the structure of the upper assembly in another example.
Figure 12:
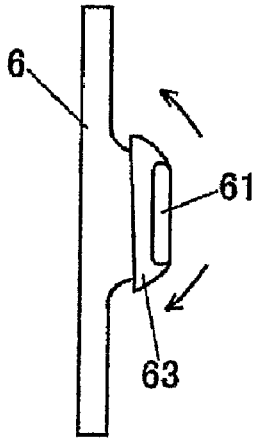
FIG. 12 is the side view of the swing assembly in FIG. 11 (being in swing state).

FIG. 11 and FIG. 12 show another embodiment of the upper assembly in the present invention. The upper assembly 6 is fixed on the back of the backpack. The swing assembly 61 is a long strip-shaped swing assembly, whose middle part is connected to the upper assembly 6 through the rotating axes 63. The top of the shoulder straps 4,4' are connected with the upper symmetrical sides of the swing assembly 61 respectively. The end part of the shoulder straps 4, 4' extend to the bottom of the backpack and connect with the lower assembly, or the shoulder straps 4, 4' connect to each other directly. The swing assembly 61 will be pulled around the rotating axes 63 under the external force of the shoulder straps 4, 4', at this time, the gravity center of the backpack will be in one line with the ground by the swing assembly 61 according the lever principle, so as to achieve the balance interaction effects.

When using, the backpack will swing at the effect of its own gravity center as the two shoulders of a human body move, and the swing assembly which connected to the shoulder straps will also swing to an appropriate position via the rotating axes 63, which will make the backpack to be always perpendicular to the ground, so that the pressure on the two shoulders is balanced. The lower assembly not only can be used independently by fixing on the backpack, but also can be used together with the upper assembly.

The upper assembly and the lower assembly described in this invention can be used together, or can be used separately. When using together, the movable angle can be increased and the flexibility will be greatly improved. In this invention, the lower assembly could be installed independently, or installed together with the upper assembly, which is up to the needs of the user. The installation ways are also very flexible, which can be fixed to the rear, inner, and outer part of the backpack, and so on, and also can be fixed in the shelf and covered directly on the backpack.

This invention has a very broad usage. which may be set on different backpacks, or used as a back-strap for children, or used on the tie bar backpack with wheels, or even used at the back-shelf of the camera, the military backpack, as well as the oxygen bottles back-shelf used by firemen and so on. This invention will balance the stress on the user's shoulders, while the sliding of the shoulder straps may be controlled by the control valve of the movable device, so as to reduce the human body consumptions, and make the human body free and flexible.

What is claimed is:

1. An interactive type of a balancing device including a backpack body for containing materials, left and right shoulder straps, a balancing device, a top end and a tail end of both the left and right shoulder straps being at least one of connected with the balancing device and detachably connected with the balancing device, said balancing device comprising:

a lower assembly connected to the backpack body, the lower assembly including a baffle plate and a movable device which is installed in a hollow part of an interlayer of said baffle plate; and an upper assembly connected to the backpack body through at least one of a plastic or a metal plate, and supported by the lower assembly, wherein the left and right shoulder straps move along a rotating assembly of the upper assembly;

wherein the moveable device is installed in the hollow part of the interlayer of the baffle plate, and includes at least one rolling wheel and two left and right fixed wheels, one each set on both the left and right sides of the rolling wheel, further wherein a sliding belt is driven by the left and right shoulder straps to move along the rolling wheel and the fixed wheels within a plurality of positioning component channels.

2. An interactive type of a balancing device according to claim 1, wherein said baffle plate includes a center main plate and a left sliding plate and a right sliding plate, the baffle plate having a hollow double-layer sandwich structure, and bottoms of the left and right sliding plates have positioning components channels which are connected to an outside respectively, wherein the sliding belt moves along the plurality of positioning components channels.

3. An interactive type of a balancing device according to claim 1, wherein said rolling wheel is connected to the baffle plate through a spring.

4. An interactive type of a balancing device according to claim 1, wherein said sliding belt is connected or detachably connected to the ends of the left and right shoulder straps.

5. An interactive type of a balancing device according to claim 1, wherein said at least one rolling wheel may be two, and the movement of the sliding belt is controlled by a keyswitch installed between the two rolling wheels.

6. An interactive type of a balancing device according to claim 1, wherein a keyswitch is installed within the rolling wheel, and the sliding belt is passed through the keyswitch and connected to said left fixed wheel and said right fixed wheel.

7. An interactive type of a balancing device according to claim 1, wherein said rotating assembly includes a positioning rotary wheel which is rotating around an axis, and the left and right shoulder straps move left or right within a component channel along an outer track of the wheel.

8. An interactive type of a balancing device according to claim 7, wherein a sliding channel is set around said rotating assembly to allow the shoulder straps to slide therein.

* * * * *